United States Patent [19]

Vittoria

[11] 4,197,517

[45] Apr. 8, 1980

[54] HIGH SPEED FREQUENCY TUNABLE MICROWAVE FILTER

[75] Inventor: Carmine Vittoria, Washington, D.C.

[73] Assignee: The United States of America as represented by the Secretary of the Navy, Washington, D.C.

[21] Appl. No.: 957,126

[22] Filed: Nov. 3, 1978

[51] Int. Cl.[2] ..... H01P 1/20

[52] U.S. Cl. ..... 333/205; 333/161; 333/235

[58] Field of Search ..... 333/161, 204, 205, 207, 333/209, 233, 235

[56] References Cited

U.S. PATENT DOCUMENTS

| | | | |
|---|---|---|---|
| 3,289,112 | 11/1966 | Brown | 333/24.2 |
| 3,546,637 | 12/1970 | Wen | 333/205 |
| 3,740,675 | 6/1973 | Moore et al. | 333/205 |
| 3,889,213 | 6/1975 | Vittoria et al. | 333/209 |
| 3,913,039 | 10/1975 | Weiner | 333/205 |

*Primary Examiner*—Eugene R. LaRoche

*Attorney, Agent, or Firm*—R. S. Sciascia; Philip Schneider; Melvin L. Crane

[57] ABSTRACT

The invention is a magnetically tunable bandpass filter for use in the microwave regions, particularly for frequencies between 0.1–4 GHz. A magnetically tunable bandpass filter is a filter which will pass only certain frequencies from one conductor to a separate conductor depending upon the frequency band and the magnetic field applied across the filter. The tuning of the center frequency can be achieved at relatively fast electronic switch times. The center frequency is the frequency at which the most coupling exist due to the applied magnetic field. Two striplines are placed at 90° relative to one another with one end of one stripline overlapping one end of the other with the overlapped ends connected to ground. A disc of ferromagnetic material is placed between the two striplines. By applying a dc magnetic field and by changing the angle of the magnetic field within the disc plane, microwave signals can either be transmitted or not from one stripline to the other at a given frequency depending upon the applied magnetic field applied and the angle of application.

8 Claims, 2 Drawing Figures

HIGH SPEED FREQUENCY TUNABLE MICROWAVE FILTER

BACKGROUND OF THE INVENTION

This invention relates to magnetically tunable bandpass filters in the microwave regions and more particularly to a magnetically tunable bandpass filter operable at center frequencies lying between 0.1 to 4 GHz at relatively fast electronic switch times.

In the field of electrical filters, band-pass filters are of particular importance in many diverse electrical systems in which it is desired to pass certain frequency bands with a high selectivity over a particular range of frequencies. In certain areas of communication systems, it is frequently desirable to have filters that exhibit the desired selectivity with the capability of switching between different frequency bands in a relative rapid manner while retaining a high coupling efficiency over the frequency range of operation.

Heretofore planar YIG resonators have been used for tunable band-pass filter applications. U.S. Pat. No. 3,889,213 sets forth a magnetically tunable band-pass filter which requires a dc magnetic switching field of up to 3,000 Oersted in order to vary the frequency from 8 to 12 GHz. At these high dc magnetic field values, it is difficult to switch the center frequency at reasonable switching speeds.

Other filter systems have made use of YIG resonator elements located within a cavity positioned in close proximity to one or more transmission line conductors. For instance, see U.S. Pat. Nos. 3,289,112 and 3,740,675.

SUMMARY OF THE INVENTION

A tunable frequency filter including perpendicular transmission stripline conductors is fabricated on one planar surface of a single slab of a dielectric material mounted on a ground plane. The stripline conductors are shown near and along adjoining edge surfaces of the planar surface with the end of one conductor overlapping the end of the other conductor. The ends of the conductors at the overlap are shorted to ground. The stiplines may lie any place on the layer surface so long as their ends are grounded. A magnetic disc of YIG, lithium ferrite, or any magnetically ordered material having a (110) crystal plane is positioned between the overlapped ends of the two stripline conductors. For large frequency tuning, it is preferred to use magnetically ordered materials with high magnetic aniostropy energy. An OSM adapter (a special adapter manufactured by OMNI SPECTRA, Inc. of Michigan) is connected to the non-overlapped ends of the stripline conductors and to ground. A magnetic field of 10 Oersted is applied across the magnetic disc by two orthogonal Helmholtz coils along the surfaces of the structure near the overlapped ends of the conductors. The two Helmholtz coils allow the application of a magnetic field at an angular direction in the magnetic disc plane. Microwave frequency radiation may be directed into and out of either OSM adapter. A large center-frequency tuning range can be achieved by either (1) fixing the direction of the applied field and varying its magnitude or (2) fixing its magnitude and rotating the magnetic field within the disc plane.

DETAILED DESCRIPTION

Figure 1:
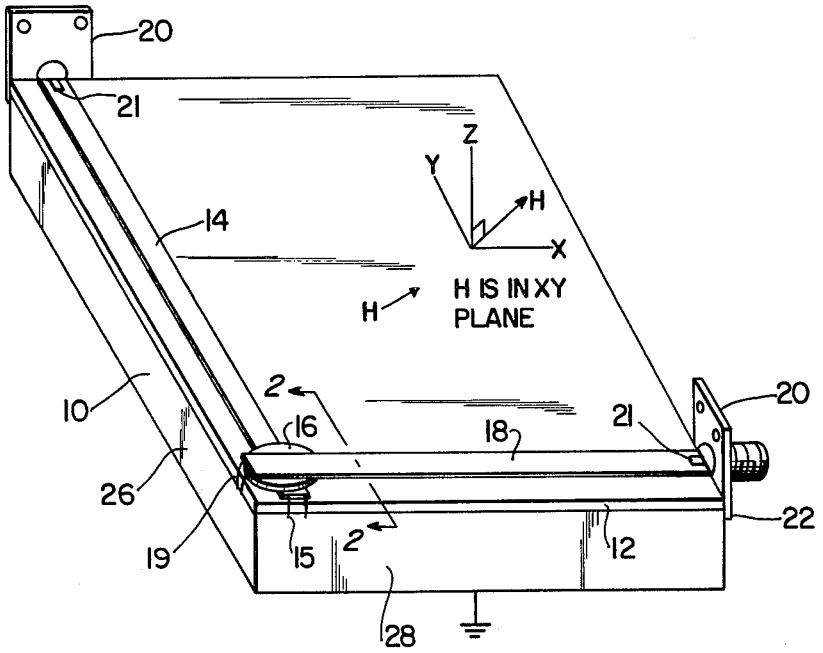
FIG. 1 illustrates a perspective view of the device, shown without the Helmholtz coils.
Figure 2:
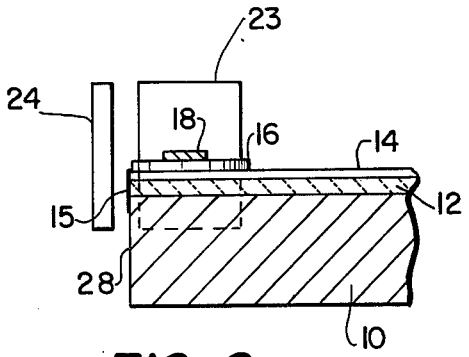
FIG. 2 illustrates a cut-away sectional view along lines 2—2 illustrating the Helmholtz coils relative to the overlapped stripline conductors and the magnetic disc.

FIG. 1 illustrates a magnetically tunable bandpass filter including a grounded metallic substrate 10 such as brass or any other suitable metal upon which a layer of dielectric material 12 such as aluminum oxide, sapphire, or some other suitable ceramic material having a thickness of from about 20 mils to about 30 mils has been deposited. A stripline conductor 14 of any suitable conductive material is deposited on the upper surface of said dielectric layer along one edge of the dielectric material and grounded at 15 to the edge of the metallic substrate. A resonant, thin disc 16 of magnetic material such as a single crystal of YIG, lithium ferrite, or a magnetically ordered material having a thickness of from 10 to about 20 microns and whose diameter is at least as large as the width of the stripline conductor is deposited over the grounded end of the stripline conductor 14. A stripline conductor 18, of the same material as conductor 14, is deposited over the disc of magnetic material and extended along the upper surface of the dielectric material near one edge and perpendicular to the stripline conductor 14. The end of stripline conductor 18 that laps over the magnetic disc is grounded to the metallic substrate at 19. An OSM adapter 20 is connected with the non-grounded end of each of the stripline conductors to serve as the input and output terminals which are bidirectional. Each OSM adapter is electrically connected such that its center pin 21 connects with the stripline conductor and the outer surface 22 is connected to the metallic substrate or ground.

A dc, 10 Oersted, magnetic field is applied in the plane of the magnetic disc by use of two orthogonally positioned Helmholtz coils 23 and 24 which are placed along the faces 26 and 28 of the filter near the magnetic disc. With the two Helmholtz coils so positioned, it is possible to apply a dc magnetic field at any direction in the disc plane by rotating the magnetic field through small angles. By rotation of the magnetic field in the plane of the magnetic disc, a large center frequency tuning range of between 0.1 to 4 GHz can be achieved. The magnetic field may be rotated by varying the current applied to the Helmholtz coils.

When microwave energy is applied to either of the stripline conductors through the OSM adapters and the dc biasing magnetic field is applied to the resonant magnetic disc, only signals within a predetermined frequency range will pass the magnetic disc and be coupled from one stripline conductor to the other stripline conductor, when the magnetic disc is at its point of magnetic resonance. Electromagnetic coupling between the two stripline conductors occur only when the magnetic disc is magnetically "active", that is, resonant. The disc is magnetically "active" only at a given frequency which depends on the magnetic field direction and amplitude.

The energy permitted to pass through the filter is controlled by the crystal plane of the magnetic disc and the direction in which the dc magnetic field is applied. For example, using a magnetic disc whose crystal plane is (110) and applying a field of 10 Oe along the <111> axis, the filter center frequency is 3.6 GHz for lithium ferrite and 0.96 GHz for YIG, for example. Applying the same field at 35.4 degrees from the previous direction and along the <110> axis, the center frequency is 4 GHz for lithium ferrite and 1.16 GHz for YIG. The bandwidth is approximately 2 MHz for each. By rotating the dc magnetic field so that the field is along the <100> axis, it is possible to obtain a low center-frequency of approximately 0.2 GHz. Thus, by simply rotating the applied dc field of 10 Oe within small angles a large range of center-frequency tuning can be achieved. Since such a low value of dc magnetic field is required (10 Oe), it is possible to vary the dc magnetic field very fast.

The operation of the device is such that if an input signal is between 1 GHz and 4 GHz the filter is capable of passing a signal of a particular frequency to the output terminal instantly. The frequency of the signal passed will depend upon the direction and amplitude of the magnetic field. By changing the direction and amplitude of the magnetic field which can be done in a short time, different frequencies can be coupled through the filter. Those input signals other than those previously assigned will not pass and will not exit at the output terminal.

In order to insure coupling between the two stripline conductors at all tunable frequencies, the magnetic disc is placed near the electrical shorts of the stripline conductors. This is due to the fact that near the electrical shorts, the r.f. magnetic field is maximum.

The device has been set forth using YIG or lithium ferrite as the magnetic disc material. Any magnetic material having a high magnetic anisotropy and magnetization and narrow linewidth can be used. These materials can be tuned over a wide frequency range by varying the dc magnetic field at selected directions over a wide frequency range.

The magnetically tunable bandpass filter made in accordance with the teaching of this invention is easy to fabricate since the elements are planar. The operating frequency may be easily controlled by use of the varying magnetic field and may be tuned over a large range with very fast electronic switch times.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A magnetically tunable bandpass filter for use in microwave regions which comprises:

a metallic substrate having upper and lower parallel faces;

a layer of dielectric material having upper and lower parallel faces with said lower face abutting said upper face of said metallic substrate;

a first stripline conductor on the upper surface of said dielectric layer and grounded at one end to said metallic substrate;

a second stripline conductor on the upper surface of said dielectric layer perpendicular to said first stripline conductor with one end thereof overlapping the ground end of said first stripline conductor, said overlapping end of said second stripline conductor being grounded to said metallic substrate;

a resonant disc, having a high magnetic anisotropy field value, placed between the first and second stripline conductors near their grounded ends;

means near the grounded ends of said stripline conductors for applying a dc magnetic field in the plane of said resonant disc at different desired angles; and first and second electrical connectors electrically connected to the non-grounded ends of said first and second stripline conductors for coupling electromagnetic energy to and from said stripline conductors when said resonant disc is magnetically active.

2. A magnetically tunable bandpass filter for use in microwave regions as claimed in claim 1, wherein:

said means for applying a magnetic field in the plane of said resonant disc is a pair of orthogonal Helmholtz coils placed near the grounded ends of said first and second stripline conductors.

3. A magnetically tunable bandpass filter for use in microwave regions as claimed in claim 1, wherein:

said resonant disc is lithium ferrite or a YIG ferrite.

4. A magnetically tunable bandpass filter for use in the microwave regions as claimed in claim 1, wherein:

the material of said resonant disc is a YIG ferrite.

5. A magnetically tunable bandpass filter for use in the microwave region as claimed in claim 4, wherein:

said means for applying a dc magnetic field in the plane of said resonant disc is a pair of orthogonal Helmholtz coils placed near the grounded ends of said first and second stripline conductors.

6. A magnetically tunable bandpass filter for use in the microwave regions as claimed in claim 5, wherein:

said metallic substrate is formed of brass, and said dielectric layer is formed of aluminum oxide.

7. A magnetically tunable bandpass filter for use in the microwave region as claimed in claim 1, in which:

said resonant disc is formed from lithium ferrite.

8. A magnetically tunable bandpass filter for use in the microwave region as claimed in claim 7, wherein:

said means for applying a dc magnetic field in the plane of said resonant disc is a pair of orthogonal Helmholtz coils placed near the grounded ends of said first and second stripline conductors.

* * * * *